US009267702B2

(12) United States Patent
Santini et al.

(10) Patent No.: US 9,267,702 B2
(45) Date of Patent: Feb. 23, 2016

(54) ADJUSTABLE TRANSITION FOR ACCESSING BOX COILS

(71) Applicants: Claudio Santini, Houston, TX (US); Nicholas Raissis, Houston, TX (US)

(72) Inventors: Claudio Santini, Houston, TX (US); Nicholas Raissis, Houston, TX (US)

( * ) Notice: Subject to any disclaimer, the term of this patent is extended or adjusted under 35 U.S.C. 154(b) by 168 days.

(21) Appl. No.: 14/034,861

(22) Filed: Sep. 24, 2013

(65) Prior Publication Data

US 2015/0082825 A1 Mar. 26, 2015

(51) Int. Cl.
*F24F 13/20* (2006.01)
*F25B 39/02* (2006.01)

(52) U.S. Cl.
CPC ..... *F24F 13/20* (2013.01); *Y10T 29/49352* (2015.01)

(58) Field of Classification Search
CPC ..... F24F 12/20; F24F 13/20; F24F 3/044; F25B 39/02; F25D 17/06; F25D 23/00; Y10T 29/49352; Y10T 29/49815
USPC ..... 62/426, 419, 414, 314
See application file for complete search history.

(56) References Cited

U.S. PATENT DOCUMENTS 3,807,642 A * 4/1974 Cafferty et al. ..... 239/425.5
4,343,290 A * 8/1982 Flatte ..... F24H 3/065 126/110 E
4,353,411 A * 10/1982 Harter ..... F24F 7/04 165/129
4,383,678 A * 5/1983 Longenecker ..... C21C 5/565 266/142
4,404,816 A * 9/1983 Ibrahim et al. ..... 62/282
4,449,570 A * 5/1984 Locker ..... F24F 13/06 165/54
4,633,768 A * 1/1987 Benson ..... F24F 7/10 237/46
5,062,280 A 11/1991 Martin
5,142,883 A * 9/1992 DeWitt ..... F24F 13/32 62/265
5,284,027 A 2/1994 Martin
5,775,408 A * 7/1998 Shimek ..... F24B 1/1808 126/502
5,927,096 A 7/1999 Piccione
6,766,832 B2 7/2004 DiMarco
6,782,708 B1 8/2004 Boer
2003/0111216 A1* 6/2003 Hirao et al. ..... 165/166
2003/0116213 A1* 6/2003 DiMarco ..... F16L 9/003 138/114
2003/0194315 A1* 10/2003 Dehning et al. ..... 415/213.1
2005/0054282 A1* 3/2005 Green ..... F24F 5/0035 454/201
2005/0103465 A1* 5/2005 Brasz ..... 165/61
2008/0206698 A1* 8/2008 Su ..... F27B 3/20 432/3
2009/0050291 A1* 2/2009 Desi-Seulean et al. ..... 165/47
2009/0165733 A1* 7/2009 Ferguson ..... 122/18.3
2010/0258280 A1* 10/2010 O'Donnell et al. ..... 165/109.1
2011/0174201 A1* 7/2011 Kowald et al. ..... 110/186
2011/0189005 A1* 8/2011 Post ..... 415/204
2011/0259317 A1* 10/2011 Kameyama et al. ..... 126/344
2012/0090562 A1* 4/2012 Qiu et al. ..... 122/18.1
2012/0199109 A1* 8/2012 Thompson ..... 126/112

* cited by examiner

*Primary Examiner* — Mohammad M Ali

(57) ABSTRACT

Methods and systems are disclosed with regard to a transition used in air conditioning systems having box evaporator coils. One embodiment includes a method for accessing box evaporator coils. The method may include opening an access panel located on a transition having a first opened end and a second opened end located opposite of the first opened end, wherein the first opened end securably aligns with an opened end of a furnace, and the second opened end securably aligns with one opened end of a box housing the box evaporator coils. Further, the method may include extending a member through the access panel for interacting with the box evaporator coils.

31 Claims, 6 Drawing Sheets

ADJUSTABLE TRANSITION FOR ACCESSING BOX COILS

FIELD OF DISCLOSURE

This disclosure generally relates to an adjustable transition for air conditioning systems having box evaporator coils. More particularly, this disclosure relates to methods and systems that involve a transition with an optional viewing window that permits in situ access to box evaporator coils.

BACKGROUND

To maintain, improve, or fix the working condition of an air conditioning system, cleaning, repairing, or replacing its components may be necessary. Easily reaching these components, however, may prove difficult. For instance, with systems having box evaporator coils ("box coils"), reaching these malfunctioning, inefficient, or inoperable components often requires at least partial disassembly. After the particular problem with the box coils is remedied, then the air conditioning system must be re-assembled and sealed. Accordingly, these subordinate processes wind up consuming the vast majority of time necessary to resolve the box coil issue. As a result, the time required to remedy the box coil issue makes attendant costs so undesirable that the most cost-efficient solution from a big picture perspective may become replacing the used box coils with a new box housing new box coils rather than merely remedying the particular problem with the used box coils. Consequently, used box coils are replaced and new box coils are installed prematurely, a situation squandering time, money and materials.

SUMMARY OF THE INVENTION

In one embodiment, the method includes transitioning within an air conditioning system. The method includes positioning a first opened end of a transition, having an access panel located on the transition, to meet at a first perimeter of an opened end of a furnace. Further, the method may include positioning a second opened end of the transition, wherein the second opened end is located opposite of the first opened end, to meet at a second perimeter of another opened end of a box housing box evaporator coils. Further still, the method may include securing the transition at the first perimeter and the second perimeter. Yet further, the method may include, whether prior or during the positioning, creating the transition and/or the access panel, and securably aligning the transition having the access panel with the furnace and/or the box. Additionally and alternatively, the method may include forming the transition and/or the access panel for secured placement of the transition having the access panel.

In one embodiment, a method includes accessing box evaporator coils. The method may include opening an access panel located on a transition having a first opened end and a second opened end located opposite of the first opened end, wherein the first opened end securably aligns with an opened end of a furnace, and the second opened end securably aligns with one opened end of a box housing the box evaporator coils. Further, the method may include extending a member through the access panel for interacting with the box evaporator coils.

In yet another embodiment, the air conditioning system includes a furnace having a motor and a blower. The system may include a transition having an access panel, wherein the transition has a first opened end and a second opened end located opposite of the first opened end, wherein the first opened end securably aligns with an opened end of the furnace. Further, the system may include a box housing box evaporator coils, wherein the second opened end securably aligns with one opened end of the box, further wherein the box evaporator coils may be accessible via the access panel.

In still yet another embodiment, a method includes transitioning within an air conditioning system. The method includes positioning a first opened end of a box to meet at a perimeter of an opened end of a furnace, wherein the box has a first portion and a second portion, wherein the first portion houses box evaporator coils, wherein the second portion comprises a transition integrally connected to the box, and wherein the box evaporator coils are accessible via an access panel located on the transition. The method also includes securing the transition of the box to the perimeter.

And, in another embodiment, the air conditioning system includes a furnace having a motor and a blower. Further, the system includes a box having a first portion and a second portion, wherein the first portion houses box evaporator coils, wherein the second portion comprises a transition integrally connected to the box, and wherein the box evaporator coils are accessible via an access panel located on the transition. Further still, the system includes a first opened end of the box securably connected to the furnace.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this disclosure and are therefore not to be considered limiting of its scope, for the disclosure may admit to other equally effective embodiments.

DETAILED DESCRIPTION OF THE EMBODIMENTS

The following is a detailed description of example embodiments of the invention depicted in the accompanying drawings. The embodiments are examples and are in such detail as to clearly communicate the invention. However, the amount of detail offered is not intended to limit the anticipated variations of embodiments; on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

In addition, directional terms, such as "above," "below," "upper," "lower," "front," "back," "top," "bottom," etc., are used for convenience in referring to the accompanying drawings. In general, "above," "upper," "upward," "top," and similar terms refer to a direction away the earth's surface, and "below," "lower," "downward," "bottom," and similar terms refer to a direction toward the earth's surface, but is meant for illustrative purposes only, and the terms are not meant to limit the disclosure.

Generally disclosed are methods and systems for accessing box evaporator coils ("box coils") and transitioning within an air conditioning system having box coils as opposed to slab evaporator coils ("slab coils"). Slab coils systems only permit horizontal installations with respect to the floor and contain sheet(s) of coils. By contrast, not only are box coils more efficient than slab coils, but they permit either horizontal or vertical installations with respect to the floor. Example box coils include multi-poise A-coil, performance A-coil, N-coil vertical, and N-coil horizontal.

Figure 1:
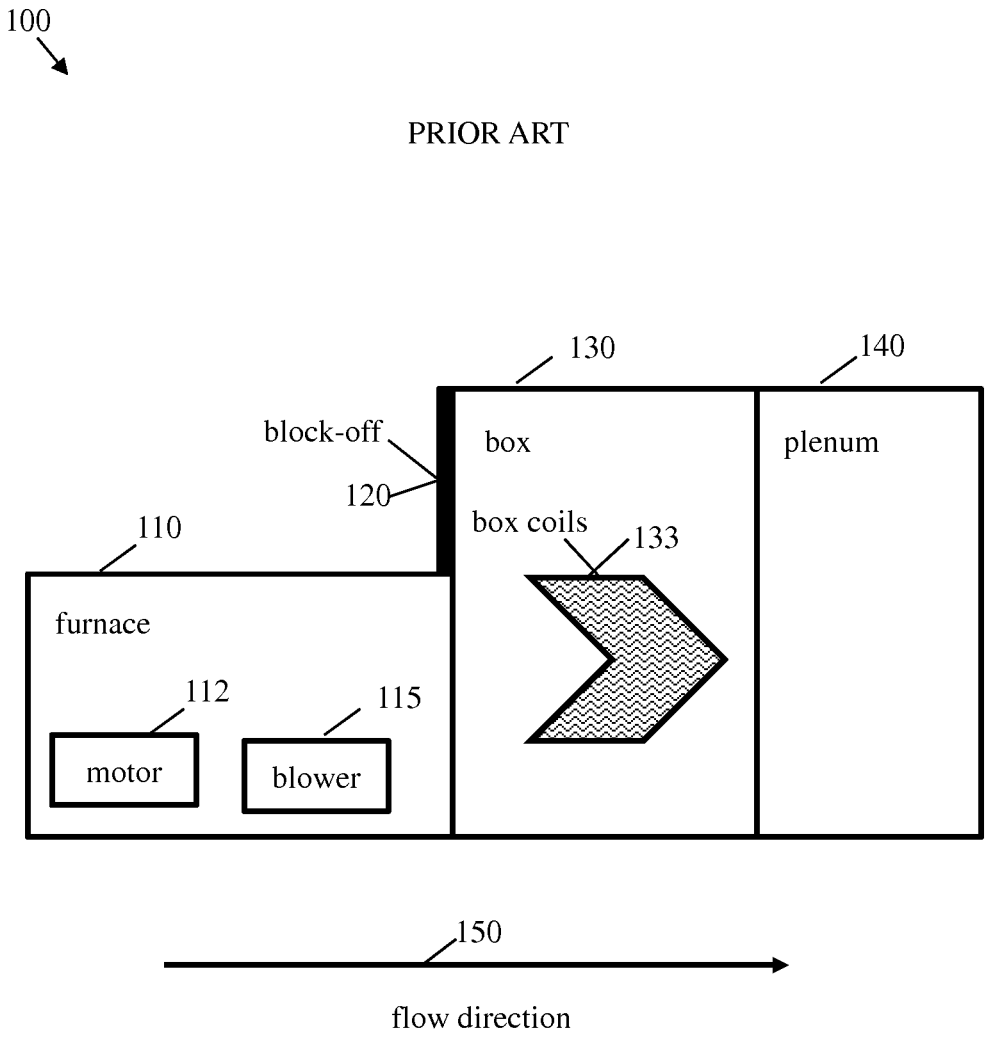
FIG. 1 depicts prior art of a side view of a system containing box coils.
Figure 3:
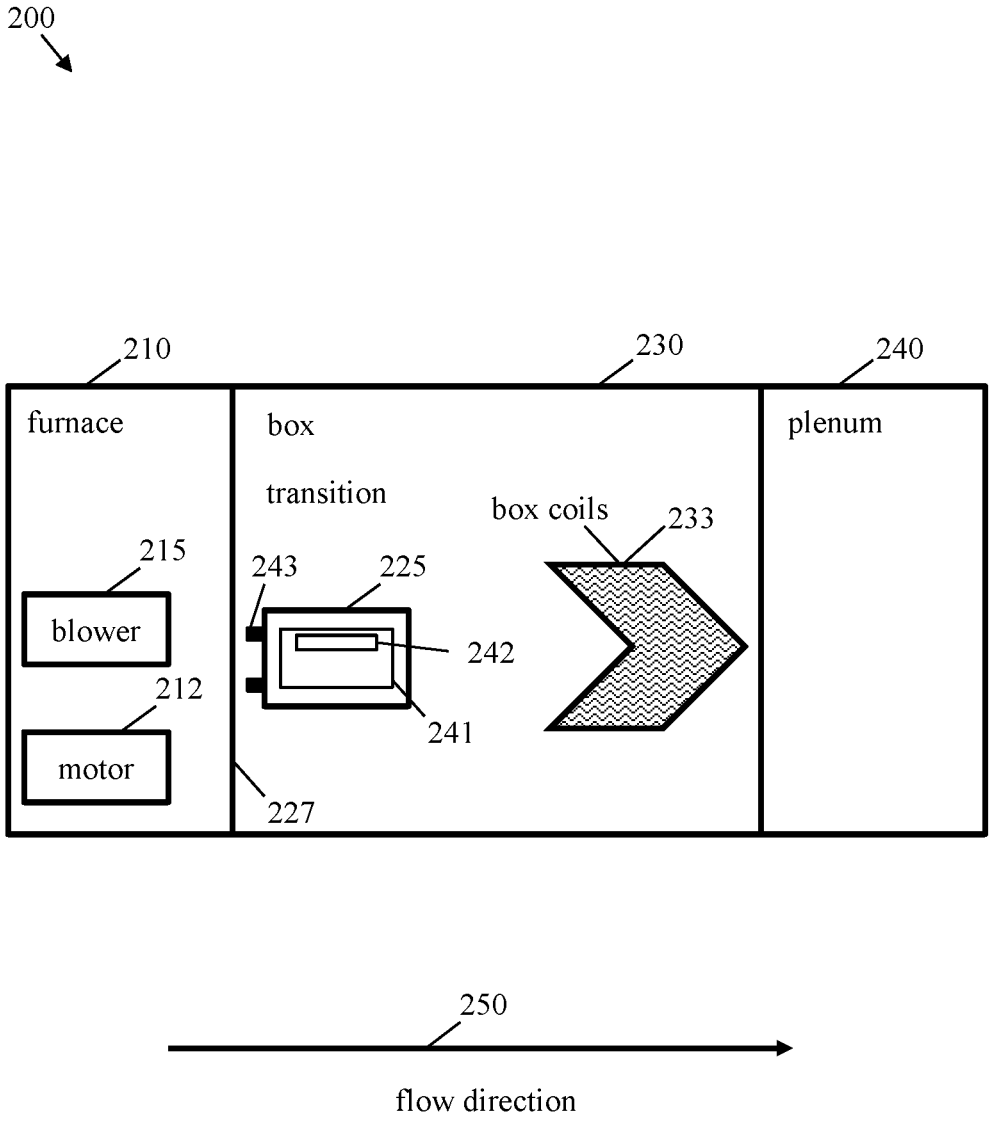
FIG. 3 depicts an example embodiment of a side view of a system in accordance with the disclosed methods and systems.

Turning now to FIG. 1, this figure depicts an example embodiment of a side view of the prior art. Here, the system 100 includes a furnace 110 having a motor 112 and a blower 115 connected to a box 130 having box coils 133 therein 130. A plenum 140 connects to the box 130 at a different place than where the furnace 110 connects to the box 130; that is, at a place other than the one opened end 231 as depicted in FIG. 3. Returning to FIG. 1, the connection between the furnace 110 and the box 130 permits the airflow 150 therethrough, but this airflow 150 is noticeably restricted by the block-off 120 connected to the box 130. The block-off 120, whether metal, plastic, wood, or other material, accommodates for the mismatch between the opened-end interface of the furnace 110 connecting to the open-ended interface of the box 130. That is, without the block-off 120, the system 100 would not be a closed system 100 because the airflow 150 would be disrupted on account of the box 130 having an open-ended portion (i.e., equal to the surface area of the block-off 120) exposed to the surroundings of the system 100.

Figure 2:
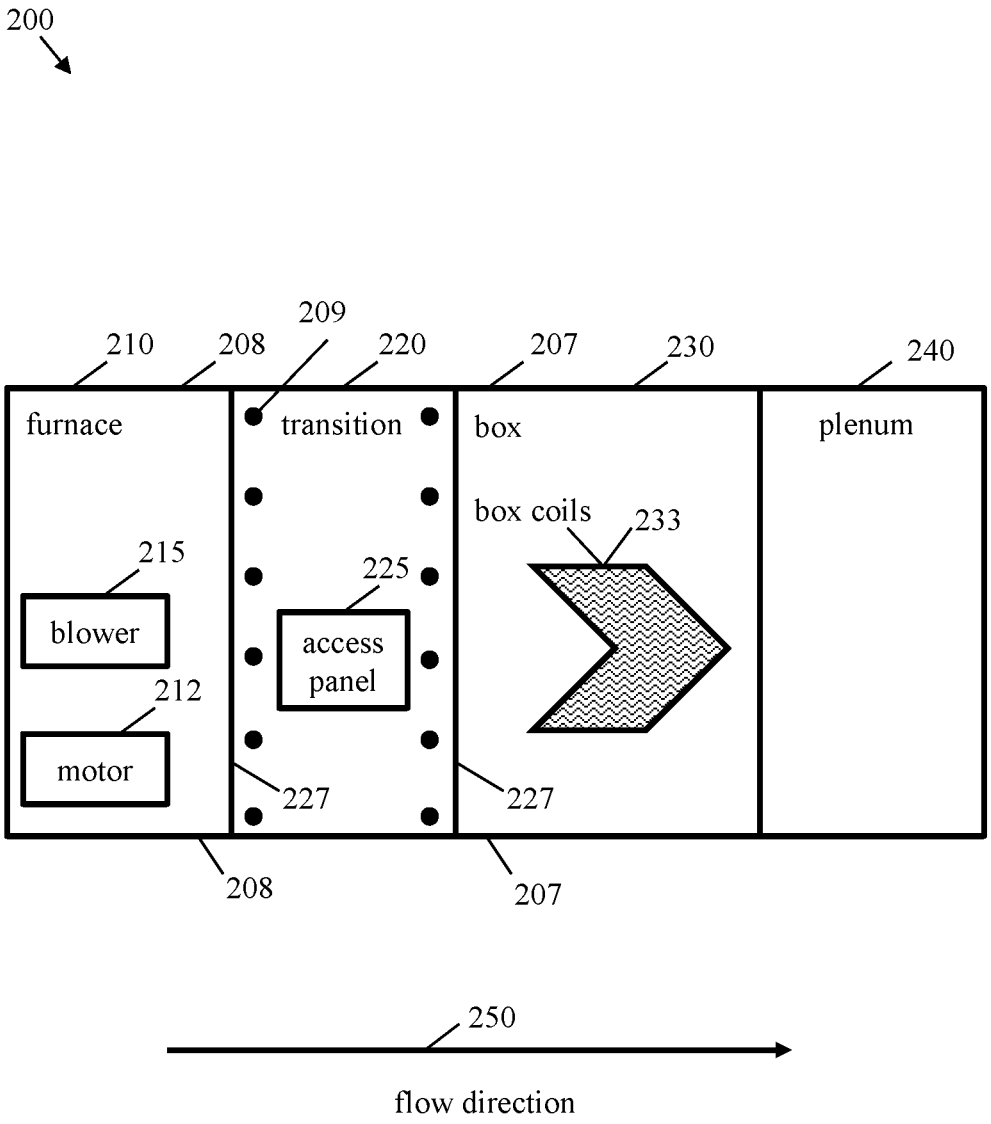
FIG. 2 depicts an example embodiment of a side view of a system in accordance with the disclosed methods and systems.
Figure 4A:
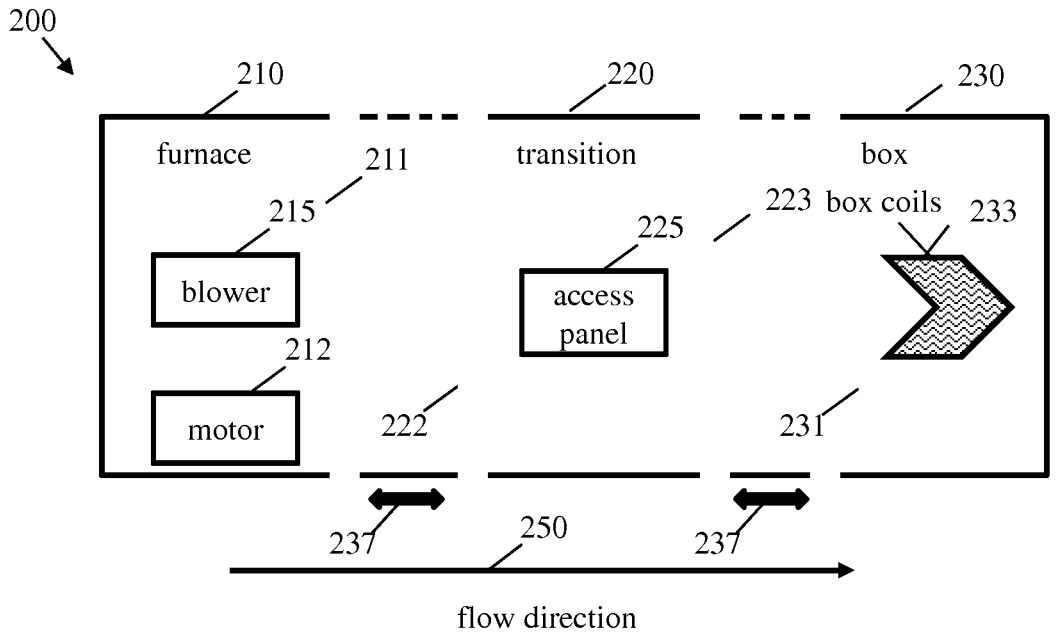
FIGS. 4A and 4B depict example embodiments of side views of systems, wherein the furnace and box are each shown to have an opened end, wherein each one aligns with a different one of the two opened ends of the transition, in accordance with the disclosed methods and systems.
Figure 4B:
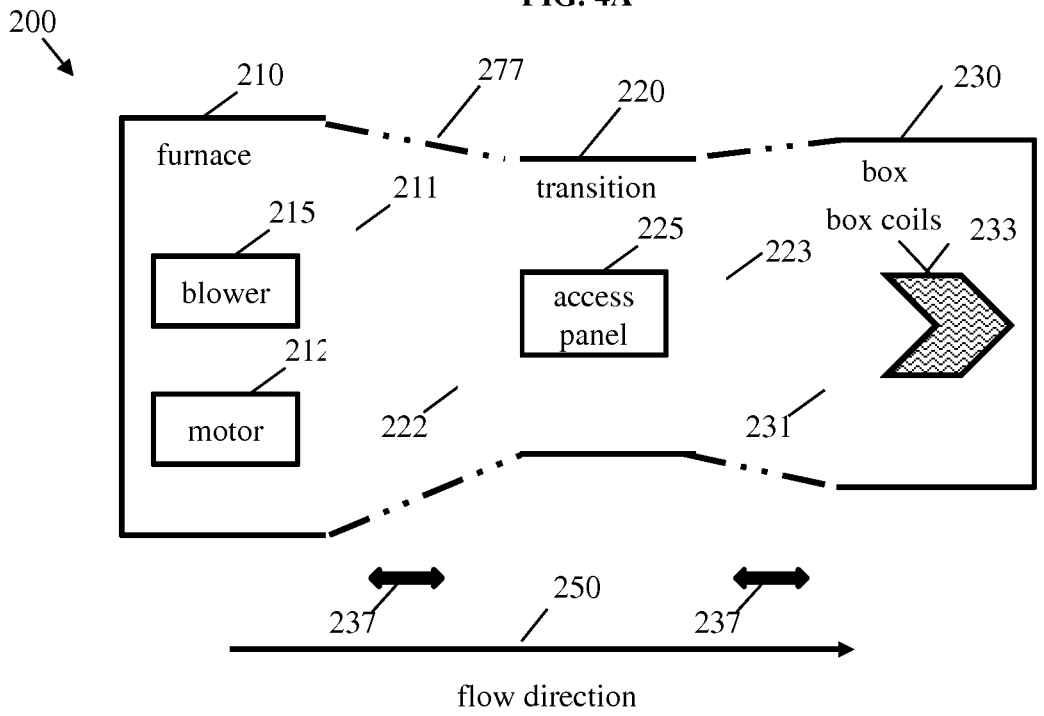
Figure 5:
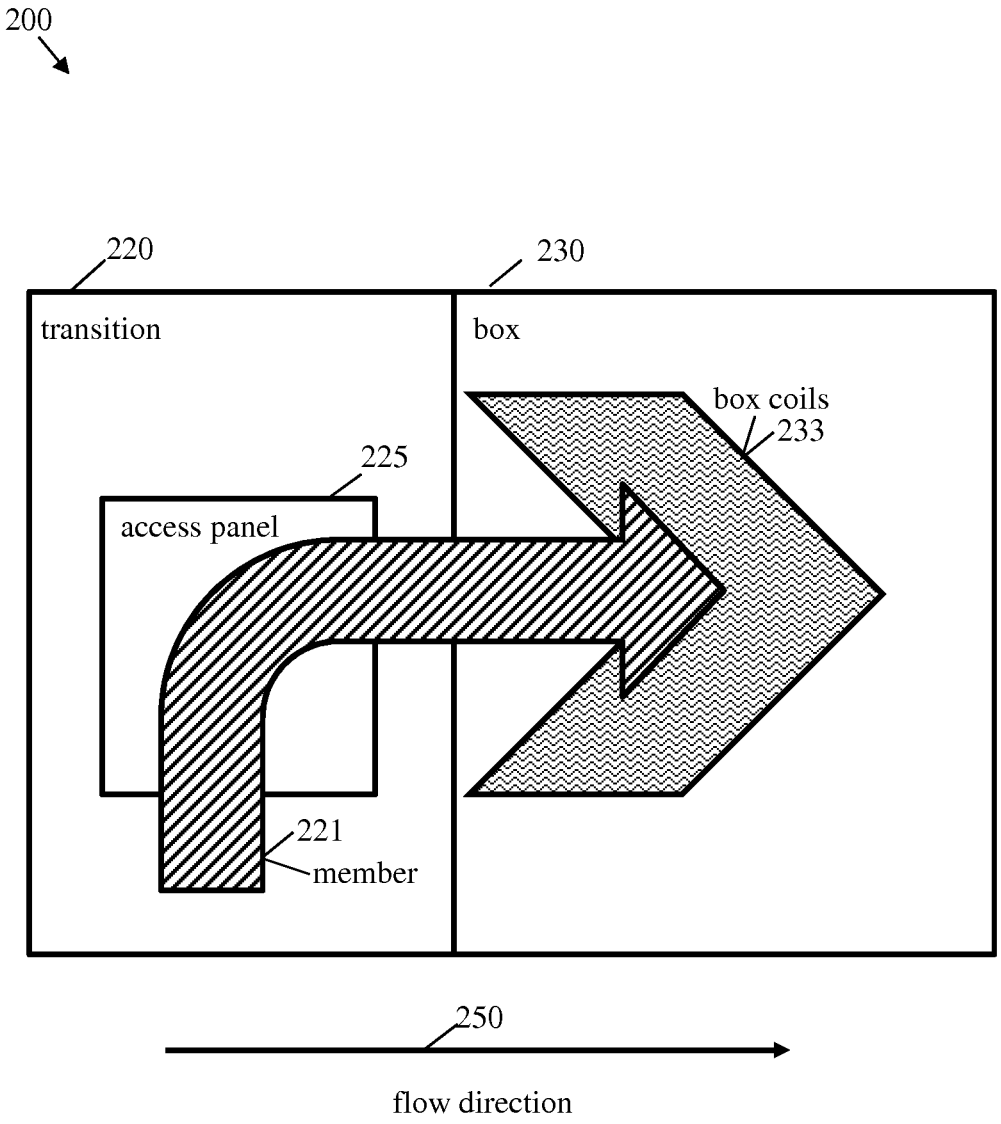
FIG. 5 depicts an example embodiment of a side view of a system having a member extending through the access panel and touching the box coils in accordance with the disclosed devices and methods.

To circumvent problems with the prior art of box coil systems, such as those systems and problems discussed above, disclosed are discussed methods and systems accompanied by FIGS. 2-6. With reference to FIGS. 2, 4 and 5, the system 200 includes a transition 220 having a first opened end 223 and a second opened end 222. The first opened end 223 is shown aligning 237 with the perimeter of the box 230 housing the box coils 223 located at a second perimeter 207 of one opened end 231 of the box 230. Similarly, the second opened end 222 is shown aligning 237 with the perimeter of the furnace 210 housing the blower 215 and the motor 212 located at a first perimeter 208 of an opened end 211 of the furnace 210. The aligning 237 shown in FIG. 3 is shown as being securably aligned 227 in FIG. 2. Securably aligning the furnace 210 and the box 230 to opposite ends 222, 223 of the transition 220 includes, by way of non-limiting example, gluing using glue 209, welding using welds 209, screwing using screws 209, riveting using rivets 209, or any other affixing method using affixing devices 209 for connecting to ensure a closed (i.e., sealed) system 200. A closed system 200 improves the efficiency for cooling the air flowing 250 through the system 200 for output through, for instance, ductwork associated with the plenum 240, which is securably aligned 227 with the box 230.

A further aspect of the system 200 includes an access panel 225 located on the transition 220 at a location other than the first opened end 223 or second opened end 222. The access panel 225, like the transition 220, may be made of metal, plastic, wood, or other material. For instance, the material for the transition 220 may be insulated sheet metal, which may be used for the plenum 240. Further, the material for the transition 220 should be non-porous and may be somewhat flexible in order to accommodate any cutting and/or bending desirable for creating, forming and/or positioning the transition 220 to securably align 227 with the furnace 210 or the box 230.

The access panel 225, itself, is located on the transition 220, and, optionally, may have a framework for integrating into the transition 220. That is, the material of the transition 220 may be cut for placing the access panel 225 into the transition 220. After placement, the access panel 225 may be securably affixed to the transition 220 by gluing, welding, screwing, riveting, and other means. In other example embodiments, the access panel 225 may be part of an extruded plastic transition 220 or part thereof 220 for making the transition 220 to be used in the disclosed methods and systems. In still further embodiments, the access panel 225 may be hingedly attached to the transition 220, wherein the hinges 243 allow for the opening and closing of the access panel 225.

As the name connotes, the access panel 225 provides access to the interior of the system 220, and, in particular, to the box coils 233. By way of non-limiting examples, the access panel 225 may provide access to the box coils 233 by opening a door 241 and/or window 242, wherein the opening may occur through for sliding, pulling or pushing. In other example embodiments, the access panel 225 may have a viewable window, regardless whether the window portion of the access panel 225 opens or not. Once the access panel is open, one may extend a member 221 inside of the transition 220 and at least part of the box 230 in order to interact with the box coils 233. The interacting may include spraying a cleaning solution onto the box coils 233 or touching the box coils 233 with a member 221, which is depicted as a large arrow on top of the box coils 233 in FIG. 4. Through touching, the box coils 233 or parts thereof 233 may, for example, be cleaned, have maintenance conducted on them 233, or be removed from the box 230. Examples of a member 221 for permitting this interaction may include a part of a human body, such as an arm extending through the transition 220 to interact with the box coils 233, or a device, such as a wrench, blow torch, screwdriver, spray bottle of solution, cloth, rod, and so forth in order to interact with the box coils 233.

While otherwise equivalent, FIG. 3 differs from FIG. 2 in one respect. That is, instead of positioning, securably aligning and securing opened ends of a separate transition 220 to a box 230, as shown in FIGS. 2, 4A and 4B, the box 230 of FIG. 3 has the transition 220 of FIG. 2 integrally connected to what would otherwise be the separate box 230 of FIG. 2. Pictorially, FIG. 3 shows the preceding sentence with the text of "transition" and its access panel 225 located in a first portion (e.g., a left side) of the box 230, and the box coils 233 located in a second portion (e.g., a right side) of the box 230. Although this was one example, other examples arrangements within the box 230 of FIG. 3 are equally possible. It is further noted that an example of an integral connection is any seamless material formation, e.g., a continuous metal sheet on at least each of the six sides of a box 230 having two ends opened, wherein the box has one side with the access panel 225.

Figure 6:
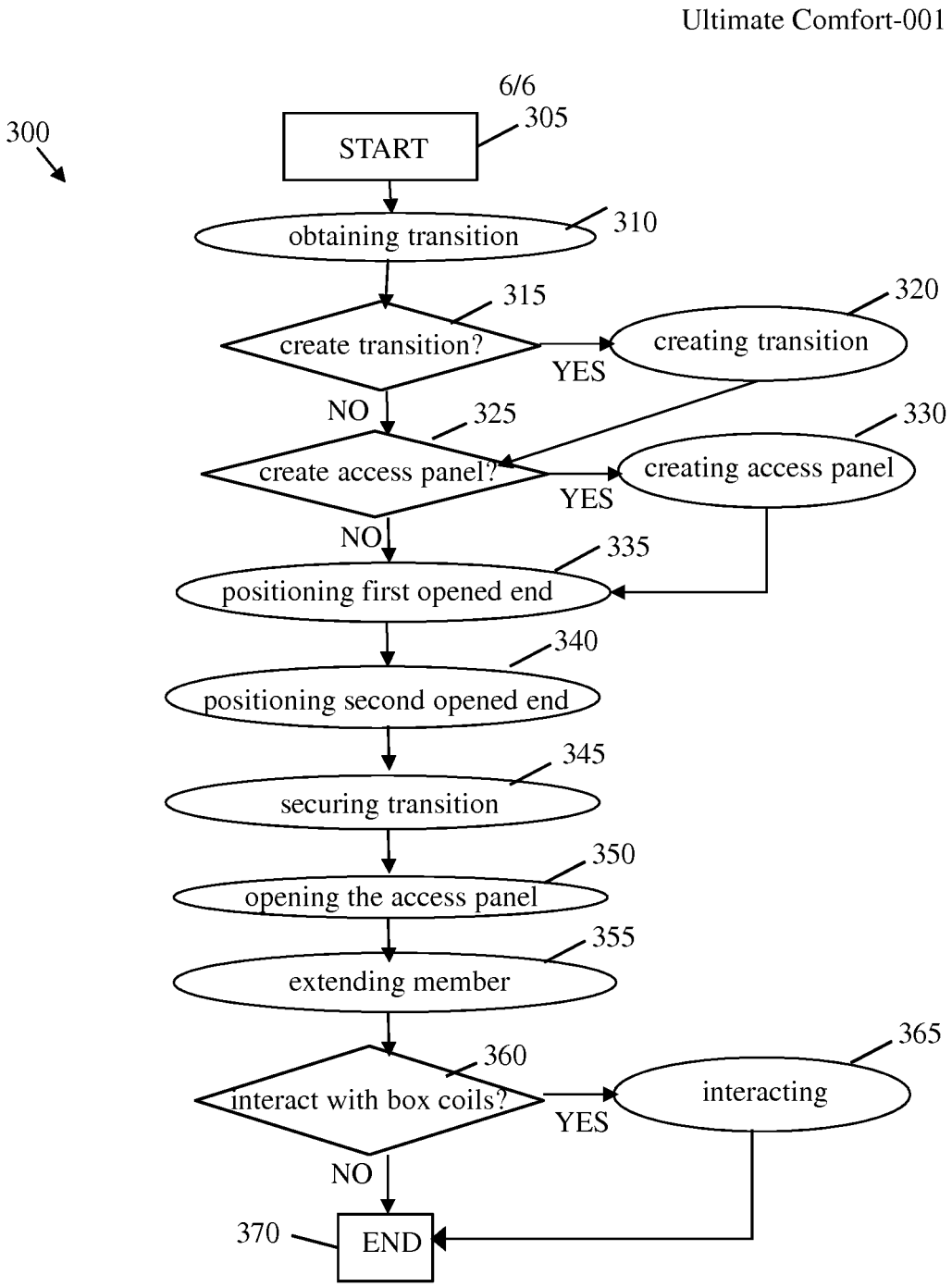
FIG. 6 depicts an example embodiment of a flowchart for transitioning within an air conditioning system and accessing box coils in accordance with the disclosed devices and methods.

Moving on to FIG. 6, yet a further aspect of the disclosure is presented. FIG. 6 depicts an example embodiment of methods contemplated by this disclosure in the form of a flowchart 300. Flowchart 300 starts 305 by obtaining 310 the transition. The transition may be obtained 310 as a ready-to-use kit of selectable pieces of flexible and non-porous material, such as metal optimally combined with one or more non-flexible materials for imparting assured integrity, for constructing a semi-customizable transition. By way of other examples, the transition may be obtained 310 by constructing the transition from flexible and non-porous materials or by purchasing a manufactured transition of proper size for use in a particular air conditioning system in accordance with this disclosed systems and methods herein.

The flowchart 300 continues by querying whether to create 315 the transition. If the obtained 310 transition is an inexact or undesirable fit for placement between the furnace and the box housing the box coils, then the answer to the query 315 may be yes. Creating 320 the transition, such as by cutting and/or forming the piece(s) of material(s) used for the transition, including securably interconnecting these pieces by riveting, screwing, gluing, and/or other methods, may be advisable in example embodiments where the opposing opened ends are oversized for the later positioning 335, 340 of these opened ends. The piece(s) of material(s), for example, may be sheets of metal, such as that use for a plenum, plastic, or combinations thereof. Additionally and alternatively, creating 320 the transition may be necessary where the access panel needs to be inserted into the transition. Such an example embodiment may exist where an obtained 310 transition does not already have an access panel already integrated into a panel of the transition.

Whether the answer is no to the query 315, such as when the obtained 310 transition having the access panel is an exact or sufficient fit for placement between the furnace and the box housing the box coils, or the answer to the query 315 was yes, wherein the transition was created 320, the flowchart 300 next queries 325 whether create the access panel. If yes, then similar to creating 320 the transition, the access panel may be created 330 by cutting and forming, for example, from either a kit for assembling an access door or raw materials such as metal, plastic, hinges, a small door knob and optionally a transparent material such as glass or plastic. The type of access panel created 330 may include a framed or frameless sliding, pull or push door access panel with or without a transparent section, which permits viewing without having to open the access panel. Thereafter, the created 330 access panel may be affixed to the transition piece using glue, screws, rivets, a weld, another mechanism or combinations thereof.

Progressing down the flowchart 300, the first of two positioning 335, 340 steps occur. Either of these positioning 335, 340 steps may occur before the other. Nevertheless, the flowchart 300 positions 335 the first opened end of the transition, having an access panel, to meet at a perimeter of an opened end of a furnace. When meeting in this fashion, that is, at the perimeters of the transition and the furnace, then maximum airflow occurs therebetween. There is no block-off 120 to impede airflow as shown in FIG. 1. Similarly, the flowchart 300 positions 340 the second opened end of the transition, wherein the second opened end is located opposite the first opened end, to meet at the perimeter of a opened end of a box housing the box coils. Again, when meeting in this fashion, that is, at the perimeters of the transition and the box, then maximum airflow occurs therebetween.

Various example embodiments exist for the positioning 335, 340, itself. One example is that the positioning 335, 340 merely brings the first and second opened ends of the transition to meet the perimeters of the furnace and the box for a system having a configuration such as that shown in FIGS. 2-4B. Another example is a transition that has an accordion feature located at the first and/or second opened ends of the transition, whereupon the accordion feature is reversibly expandable to permit the perimeters of the first and second opened ends of the transition to meet with the perimeters of the furnace and the box for a system having a configuration such as that shown in FIGS. 2-4B. And, with particular reference to FIG. 4B, a further example is a transition 200 that has a telescoping feature 277 located at the first and/or second opened ends 222, 223 of the transition 200, whereupon the telescoping feature 277 is reversibly expandable to permit the perimeters of the first and second opened ends 222, 223 of the transition 200 to meet with the perimeters of the opened ends 211, 231 of the furnace 210 and the box 230, respectively, for a system 200 having a configuration, such as that shown generally in FIGS. 2-4B and specifically in FIG. 4B. The telescoping feature 277 may include a multi-tiered, interleaved, transition that telescopes in order to facilitate a varied and facile interconnection between the transition 220 and the furnace 210, box 230, or both.

Following positioning 335, 340, the flowchart 300 continues by securing 345 the transition to the perimeters of the furnace and the box. The securing 345 may include any method to ensure air does not leak out of the air conditioning system. To that end, examples of securing 345 opposite ends of the transition having the access door to the furnace and the box include gluing, screwing, riveting, welding, or combinations thereof. The same examples of securing 345 extend to securing the access panel to a face of the transition if assembly of the transition having the access panel is required.

Moving down the flowchart 300, the access panel may be opened 350, for example, by sliding, pulling, or pushing open a door and/or window depending on particular type of access door is located on the transition. Once opened 350, it is possible to extend 355 a member, such as a hand or device, into the box having the box coils. The flowchart queries 360 whether interaction with the box coils is desired. If yes, interacting 365 may occur, for example, by using the member to clean the box coils through the access door, remove the box coils or parts thereof through the access door, or conducting maintenance on at least one of the box coils through the access door. Notably, all such interacting 365 with the box coils may occur without having to disassemble, re-assemble and re-seal in accordance with the disclosed methods and systems herein. Thereafter, or if the answer to query 360 is no, the flowchart 300 ends 370.

While the foregoing is directed to example embodiments of the disclosed invention, other and further embodiments of the invention may be devised without departing from the basic scope thereof, and the scope thereof is determined by the claims that follow.

What is claimed is:

1. A method of transitioning within an air conditioning system, the method comprising:

positioning a first opened end of a transition, having an access panel located on the transition, to meet at a first perimeter of an opened end of a furnace;

positioning a second opened end of the transition, wherein the second opened end is located opposite of the first opened end, to meet at a second perimeter of another opened end of a box housing box evaporator coils; and securing the transition at the first perimeter and the second perimeter.

2. The method of claim 1, further comprising creating the transition for the positioning.

3. The method of claim 2, wherein the creating comprises forming one or more materials into the transition having the first opened end opposed by the second opened end, wherein the one or more materials are securably interconnected.

4. The method of claim 1, further comprising creating the access panel for the positioning.

5. The method of claim 1, further comprising securing the access panel to the transition.

6. The method of claim 1, wherein the positioning comprises adjusting an accordion feature of the transition.

7. The method of claim 1, wherein the positioning comprises adjusting a telescoping feature of the transition.

8. The method of claim 1, wherein the securing comprises riveting.

9. The method of claim 1, wherein the securing comprises screwing.

10. The method of claim 1, wherein the securing comprises welding.

11. A method of accessing box evaporator coils, the method comprising:

opening an access panel located on a transition having a first opened end and a second opened end located opposite of the first opened end, wherein the first opened end securably aligns with an opened end of a furnace, and the second opened end securably aligns with one opened end of a box housing the box evaporator coils; and extending a member through the access panel for interacting with the box evaporator coils.

12. The method of claim 11, further comprising cleaning the box evaporator coils.

13. The method of claim 11, further comprising removing at least one of the box evaporator coils.

14. The method of claim 11, further comprising conducting maintenance on at least one of the box evaporator coils.

15. The method of claim 11, further comprising touching the box evaporator coils.

16. The method of claim 11, wherein the opening comprises sliding the access panel.

17. The method of claim 11, wherein the opening comprises pulling the access panel.

18. The method of claim 11, wherein the opening comprises pushing the access panel.

19. The method of claim 11, wherein the opening comprises swinging on hinges attached to the access panel.

20. The method of claim 11, wherein the opening comprises opening a window associated with the access panel.

21. The method of claim 11, wherein the opening comprises opening a door associated with access panel.

22. The method of claim 11, wherein the member comprises a part of a human body for interacting with the box evaporator coils.

23. The method of claim 11, wherein the member comprises a device for interacting with the box evaporator coils.

24. An air conditioning system comprising:

a furnace having a motor and a blower;

a transition having an access panel, wherein the transition has a first opened end and a second opened end located opposite of the first opened end, wherein the first opened end securably aligns with an opened end of the furnace; and a box housing box evaporator coils, wherein the second opened end securably aligns with one opened end of the box, further wherein the box evaporator coils are accessible via the access panel.

25. The system of claim 24, further comprising a plenum connected to the box other than at the one opened end.

26. The system of claim 24, wherein the access panel is at a location on the transition other than the first opened end and a second opened end.

27. The system of claim 24, wherein the system has a vertical alignment with respect to a floor, whereby only the furnace rests on the floor.

28. The system of claim 24, wherein the system has a horizontal alignment with respect to a floor, whereby the furnace, the transition, and the box rest on the floor.

29. A method of transitioning within an air conditioning system, the method comprising:

positioning a first opened end of a box to meet at a perimeter of an opened end of a furnace, wherein the box has a first portion and a second portion, wherein the first portion houses box evaporator coils, wherein the second portion comprises a transition integrally connected to the box, and wherein the box evaporator coils are accessible via an access panel located on the transition; and securing the transition of the box to the perimeter.

30. An air conditioning system comprising:

a furnace having a motor and a blower; and a box having a first portion and a second portion, wherein the first portion houses box evaporator coils, wherein the second portion comprises a transition integrally connected to the box, and wherein the box evaporator coils are accessible via an access panel located on the transition; and a first opened end of the box securably connected to the furnace.

31. A kit for creating a transition, the kit comprising:

one or more pieces of flexible, non-porous materials adapted to form a perimeter of the transition;

affixing devices adapted to securably interconnect the one or more pieces of flexible, non-porous materials; and at least one access panel adapted to securably insert into or affixing to at least one of the one or more pieces of flexible, non-porous materials.

* * * * *